United States Patent [19]

Gorin

[11] 4,094,766

[45] June 13, 1978

[54] COAL LIQUEFACTION PRODUCT DEASHING PROCESS

[75] Inventor: Everett Gorin, San Rafael, Calif.

[73] Assignee: Continental Oil Company, Stamford, Conn.

[21] Appl. No.: 764,617

[22] Filed: Feb. 1, 1977

[51] Int. Cl.[2] ..... C10G 1/08

[52] U.S. Cl. ..... 208/10; 208/8

[58] Field of Search ..... 208/8, 10

[56] References Cited

U.S. PATENT DOCUMENTS

| | | | |
|---|---|---|---|
| 2,871,181 | 1/1959 | Kulik | 208/8 |
| 3,010,893 | 11/1961 | Kulik | 208/8 |
| 3,598,718 | 8/1971 | Gleim et al. | 208/8 |
| 4,028,219 | 6/1977 | Baldwin et al. | 208/8 |

*Primary Examiner*—Delbert E. Gantz
*Assistant Examiner*—James W. Hellwege
*Attorney, Agent, or Firm*—D. Leigh Fowler, Jr.; F. Lindsey Scott; William A. Mikesell, Jr.

[57] ABSTRACT

Liquefaction of coal is effected by extraction of coal by a distillable solvent in the presence of hydrogen under conditions selected to produce a coal liquefaction product, the major portion of which is distillable. The effluent slurry product is vacuum distilled to recover the distillables including the solvent. The bottoms fraction is subjected to solvent treatment or fractionation to selectively recover the lower molecular weight portion, which portion is hydrogenated to yield distillate fuels. The remainder of the bottoms fraction is used as feed to a gasifier to make a hydrogen-rich gas or a methane-rich gas as desired.

2 Claims, 1 Drawing Figure

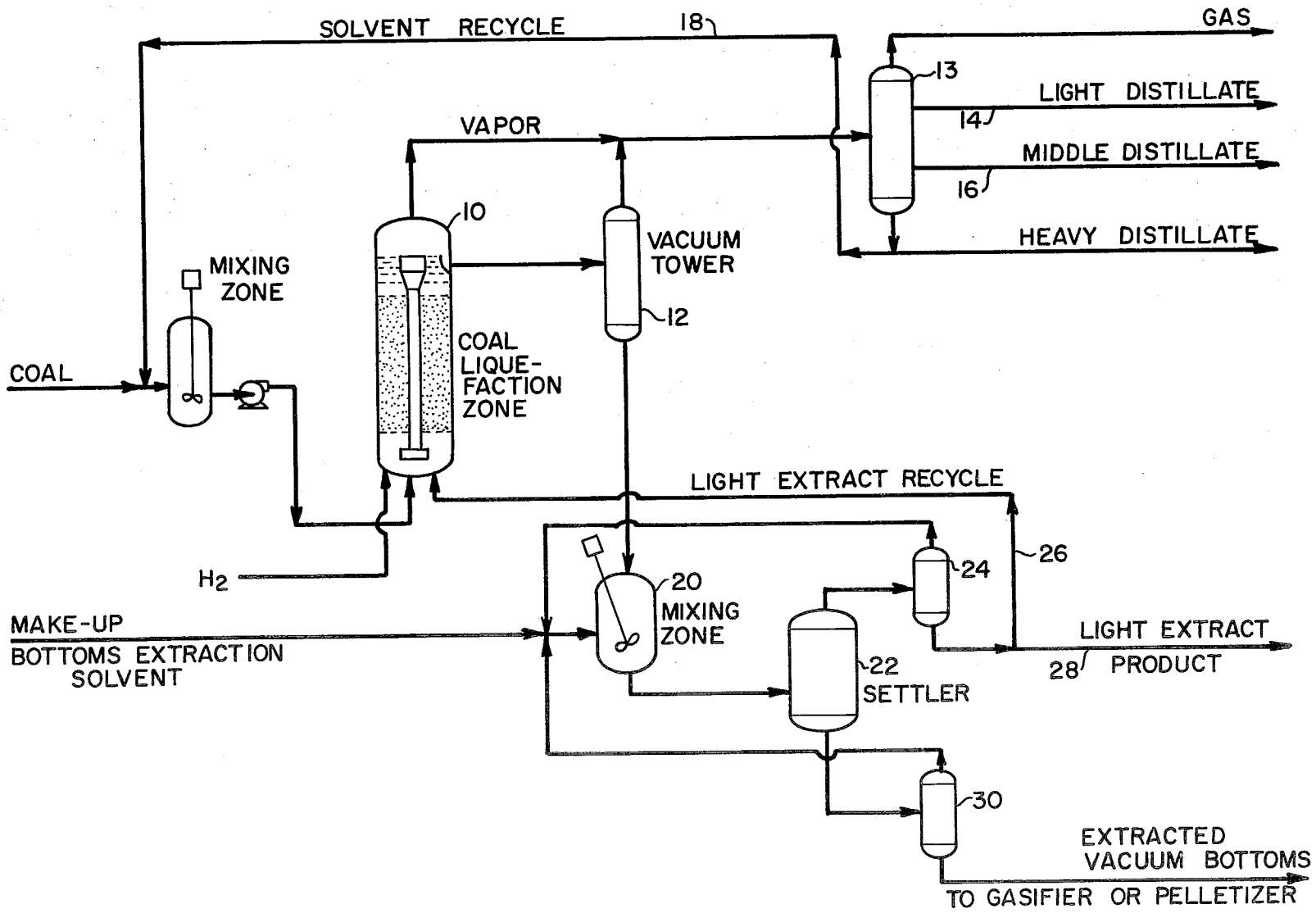
GAS
LIGHT DISTILLATE
MIDDLE DISTILLATE
HEAVY DISTILLATE
13
14
16
18
SOLVENT RECYCLE
VAPOR
VACUUM TOWER
12
10
COAL LIQUE-FACTION ZONE
MIXING ZONE
COAL
LIGHT EXTRACT RECYCLE
26
24
LIGHT EXTRACT PRODUCT
28
22
SETTLER
20
MIXING ZONE
30
EXTRACTED VACUUM BOTTOMS
TO GASIFIER OR PELLETIZER
H2
MAKE-UP BOTTOMS EXTRACTION SOLVENT

COAL LIQUEFACTION PRODUCT DEASHING PROCESS

The present invention relates to an improvement in coal liquefaction processes which use a liquefaction solvent in the presence of hydrogen to effect liquefaction of the coal.

Many coal liquefaction processes are known which include solvent extraction of coal in the presence of hydrogen at elevated temperatures as their essential conversion step. All these processes produce a slurry effluent. This slurry effluent contains, in varying proportions, coal extract, coal liquefaction solvent, and undissolved ash-containing carbonaceous residue.

The coal extracts so obtained have a wide spectrum of molecular weights, some in the distillable range and the rest in the non-distillable. The relative proportion of distillable and non-distillable coal extract fractions is a function of the coal feedstock and the conditions maintained in the coal liquefaction zone, in a manner well known to those skilled in the art.

It is common to most coal liquefaction processes to separate the undissolved solids from the coal extract in the slurry effluent from the coal liquefaction zone, before proceeding with further processing steps. While the distillable fraction of the extract may be readily separated by distillation, the separation of the non-distillable fraction from the solids has proven to be expensive as well as difficult in so far as complete separation is concerned.

The primary object of this invention is to provide an improvement in the above-described coal liquefaction processes whereby the separation of undissolved solids from the non-distillable extract is greatly simplified and therefore readily and inexpensively accomplished.

The following patents were considered in the preparation of this application: U.S. Pat. Nos. 3,018,241; 3,607,716; 2,060,447; 2,144,409; 2,221,410 and 3,583,900.

In accordance with my invention, an improvement in those coal liquefaction processes which use a distillable liquefaction solvent in the presence of hydrogen to effect the desired liquefaction is provided. The improvement comprises operating the coal liquefaction step under conditions which result in the production of a coal liquefaction product, the major portion of which is distillable. The entire effluent slurry product is vacuum distilled to remove the distillables, as well as the distillable liquefaction solvent, thereby leaving a bottoms fraction. The latter consists essentially of undissolved solids and non-distillable coal liquefaction product or residuum which is flowable at elevated temperatures. This bottoms fraction in liquid phase is mixed at elevated temperature with a distillable fractionating solvent which preferentially dissolves the lower molecular weight part of the non-distillable residuum. Two liquid phases are formed at the elevated temperature and may be readily separated. The lower molecular weight part of the residuum is recovered from the separated solution by distilling off the fractionating solvent, and at least part of it is preferably recycled to the coal liquefaction zone for conversion to distillable extract. The solids-containing phase may be used as feedstock, preferably after being pelletized, to a steam-carbon gasifier.

The advantages of my improvement include the following. The separation of the undissolved solids becomes only an incidental and relatively inexpensive step in the recovery of the extract in a distillable form. The hydrogen-poor bottoms fraction from the solvent fractionation zone is selectively isolated for conversion to gas-making materials. The fractionating solvent is employed at a point, namely after removal of the distillable coal liquefaction product and the coal solvent, to thereby minimize its consumption, and increase its effectiveness.

For a better understanding of my invention, its objects and advantages, reference should be had to the following detailed description and to the accompanying drawing in which the preferred embodiment of my invention is shown.

Referring to the drawing, comminuted coal, for example, −14 mesh Tyler Standard screen, is introduced into a solvent extraction zone 10 concurrently with 0.5 to 4.0 parts by weight of coal liquefaction solvent and a stream of $H_2$. The extraction zone 10 is adapted to confine the liquefaction solvent and $H_2$ in an ebullated bed (described in U.S. Pat. No. Re. 25,770), i.e. a liquid phase fluidized bed, in the presence of a suitable hydrogenation or hydrocracking catalyst. The catalyst temperature and residence time are selected to result in the production of coal liquefaction product, the major portion of which is distillable without decomposition. The pressure is that required to maintain the solvent as a liquid at the selected temperature, preferably in the range of 500 to 6500 p.s.i.g.

Suitable solvents for the coal in the extraction zone are those which are predominantly polycyclic hydrocarbons, preferably partially or completely hydrogenated aromatics, including naphthenic hydrocarbons, which are liquid under the temperature and pressure of extraction. Mixtures of these hydrocarbons are generally employed, and are derived from intermediate or final steps of the process of this invention. Those hydrocarbons or mixtures thereof boiling between about 260° C. and 425° C. are preferred. Examples of suitable solvents are tetralin, decalin, biphenyl, methylnaphthalene, and dimethylnaphthalene.

The coal, solvent, hydrogen and catalyst particles are maintained in intimate contact within the extraction zone 10 until the solvent has dissolved the desired amount of coal, i.e. above 80 percent of weight of the m.a.f. (moisture- and ash-free) coal. To dissolve above 80 percent of the m.a.f. coal, it is necessary that hydrogen be added to the coal, hydrogen gas in the case of this preferred embodiment, although other ways are known such as hydrogen-transferring solvents. The temperature of the extraction zone should be an elevated temperature between about 100° C. and 500° C. but in no event high enough to cause appreciable coke formation.

Following extraction, the slurry effluent composed of a mixture of coal solvent, distillable and non-distillable coal liquefaction products, and undissolved solids is conducted rapidly, so as to avoid cooling of the mixture, to a vacuum tower 12. The primary function of this tower is to separate the slurry effluent into a vaporous overhead composed of liquefaction solvent and distillable coal liquefaction products and a non-distillable bottoms fraction composed of non-distillable residuum, undissolved solids and any residual coal solvent. The overhead is itself fractionated in the top of a tower 13 to yield a light oil product through a conduit 14 and a middle distillate oil product through a conduit 16. A portion of the latter is recycled through a conduit 18 to serve as liquefaction solvent.

The bottoms fraction, while still in liquid phase at the elevated temperature maintained in the vacuum distillation tower, is conducted to a mixing zone 20 where it is suitably mixed with a fractionating solvent in a stirred vessel which is maintained at a temperature above the liquefaction point of the bottoms fraction. The preferred fractionating solvents are high boiling saturated hydrocarbons boiling above 150° C. The volume ratio of the fractionating solvent to the extract is in the range of 1 to 10, the precise ratio being a function of the composition of the extract and of the amount of low molecular weight material desired.

The mixture of vacuum bottoms and fractionating solvent is conducted to a settler 22 which is suitably maintained at elevated temperature (300°-350° C.) to ensure fluidity of the mixture. Two liquid phases form, the upper layer being composed of the lower molecular weight oil dissolved in the fractionating solvent and the lower layer being the remainder of the residuum (higher molecular weight asphaltenes and benzene insolubles) and the undissolved coal solids. The two layers may be readily separated by decantation of the upper layer.

The upper layer is subjected to distillation in a flash distillation vessel 24 to recover the fractionating solvent which is recycled to the mixing zone 20. The remainder is split into two parts, one to be recycled through a conduit 26 to the coal extraction unit where it undergoes hydrogenation or hydrocracking and conversion to desired distillables. The other part is recovered through conduit 28 as product for either direct use as an ash-free fuel or as feedstock for further treatment to selected fuels.

The lower layer from the settler while still hot is conducted to a second flash still 30 where the fractionating solvent is flashed off and recycled to the mixing zone 20. The solvent-free bottoms is permitted to cool to solids that can be used as fuel directly or as feedstock for making gas, particularly hydrogen-containing gases by the steam-carbon reaction. Or it can be pelletized and indurated to be used as a non-caking carbonaceous fuel to a fixed bed gasifier for making methane.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a coal liquefaction process which uses a distillable liquefaction solvent in the presence of hydrogen in a coal liquefaction zone, the improvement which comprises:

(a) establishing and maintaining conditions in said coal liquefaction zone effective to dissolve above 80 percent by weight of the m.a.f. coal and produce a major portion of the resulting coal liquefaction product as a distillable product, (b) withdrawing an effluent slurry product from said liquefaction zone which contains distillable and non-distillable fractions, undissolved solids, and liquefaction solvent, (c) subjecting said effluent slurry product to vacuum distillation to separately recover a distillable fraction composed of liquefaction solvent and distillable coal liquefaction products and a flowable bottoms fraction composed of non-distillable residuum, undissolved solids and residual liquefaction solvent, (d) mixing said bottoms fraction with a fractionating solvent comprising a saturated hydrocarbon boiling above 150° C which preferentially dissolves the lower molecular weight part of the non-distillable residuum in a mixing zone which is maintained at a temperature above the liquefaction point of said bottoms fraction, (e) conducting the resulting mixture from step (d) to a settler which is maintained at an elevated temperature to ensure fluidity of the mixture and the formation of two liquid phases, the upper layer being composed of the lower molecular weight oil dissolved in the fractionating solvent and the lower layer being the remainder of said mixture, (f) separating the upper liquid phase from the lower liquid phase, and (g) recovering said lower molecular weight oil from said upper liquid phase.

2. The process according to claim 1 in which the coal liquefaction zone of step (a) is adapted to confine liquefaction solvent and hydrogen in an ebullated bed in the presence of a hydrogenation or hydrocracking catalyst; and the settler in step (e) is maintained at a temperature between 300° and 350° C.

* * * * *